US006860909B2

(12) United States Patent
Berlowitz et al.

(10) Patent No.: US 6,860,909 B2
(45) Date of Patent: Mar. 1, 2005

(54) LOW EMISSIONS F-T FUEL/CRACKED STOCK BLENDS

(75) Inventors: Paul Joseph Berlowitz, Glen Gardner, NJ (US); Robert Jay Wittenbrink, Kingwood, TX (US); Bruce Randall Cook, Stewartville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/461,824

(22) Filed: Jun. 13, 2003

(65) Prior Publication Data

US 2004/0144689 A1 Jul. 29, 2004

Related U.S. Application Data

(63) Continuation of application No. 09/563,214, filed on May 2, 2000, now abandoned.

(51) Int. Cl.[7] ..... C10L 1/18

(52) U.S. Cl. ..... 44/436; 44/452; 208/15; 208/27; 208/137; 208/141; 208/950; 585/733; 585/734; 585/737

(58) Field of Search ..... 585/734, 733, 585/737; 208/15, 27, 137, 141, 950; 44/436, 452

(56) References Cited

U.S. PATENT DOCUMENTS

| | | | | |
|---|---|---|---|---|
| 5,324,335 A | | 6/1994 | Benham et al. | 44/452 |
| 5,378,348 A | * | 1/1995 | Davis et al. | 208/27 |
| 5,506,272 A | | 4/1996 | Benham et al. | 518/700 |
| 5,545,674 A | * | 8/1996 | Behrmann et al. | 518/715 |
| 5,689,031 A | | 11/1997 | Berlowitz et al. | 585/734 |
| 5,792,339 A | | 8/1998 | Russell | 208/15 |
| 5,807,413 A | | 9/1998 | Wittenbrink et al. | 44/451 |
| 6,150,575 A | * | 11/2000 | Angevine et al. | 585/14 |

FOREIGN PATENT DOCUMENTS

| | | | | |
|---|---|---|---|---|
| EP | 0599 795 A | * | 6/1994 | |
| EP | 0687289 B1 | | 12/1998 | C10L/1/22 |
| WO | WO97/14769 A | * | 4/1997 | |
| WO | WO99/13031 | * | 3/1999 | |
| WO | WO99/13031 A | * | 3/1999 | |

OTHER PUBLICATIONS

Jimell Erwin et al, Southwest Research Institute, "The Standing of Fischer–Tropsch Diesel in an Assay of Fuel Performance and Emission", Nov. 26, 1993, pp. 1015–1053, NREL SUB YZ–2–133215–1.

"Standard Specification for Diesel Fuel Oils", ASTM Designation: D 975–98b, pp. 1–18.

"European Programme on Emissions, Fuels and Engine Technologies", ACEA, Europia, Executive Summary, Jul. 1995, pp. 1–12.

T. W. Ryan III et al, Southwest Research Institute, "Diesel Fuel Composition Effects on Ignition and Emissions", 932735, pp. 77–94.

K. B. Spreen et al, Southwest Research Institute, "Effects of Cetane Number, Aromatics, and Oxygenates on Emissions From a 1994 Heavy–Duty Diesel Engine With Exhaust Catalyst", 950250, pp. 238–254.

(List continued on next page.)

*Primary Examiner*—Cephia D. Toomer
(74) *Attorney, Agent, or Firm*—Jay Simon; Mark D. Marin

(57) ABSTRACT

A blend useful as a diesel fuel, as well as a method for its production, comprising a high quality Fischer-Tropsch derived distillate boiling in the range of a diesel fuel blended with a cracked stock boiling in the range of a diesel fuel wherein the final blend contains 10–35 wt. % aromatics and 1–20 wt. % polyaromatics and produces low regulated emissions levels.

28 Claims, 1 Drawing Sheet

OTHER PUBLICATIONS

T. L. Ullman et al, Southwest Research Institute, "Effects of Cetane Number on Emissions From A Prototype 1998 Heavy–Duty Diesel Engine", 950251, pp. 255–271.

M. Singer et al, "European Programme on Emissions, Fuels and Engine Technologies (EPEFE)—Heavy Duty Diesel Study", 961074, pp. 564–579.

D. J. Rickeard et al, "European Programme on Emissions, Fuels and Engine Technologies (EPEFE)—Comparison of Light and Heavy Duty Diesel Studies", 961075, pp. 580–599.

M. Hublin et al, "European Programmes on Emissions, Fuels and Engine Technologies (EPEFE)—Light Duty Diesel Study", 961073, SAE Technical Paper Series, May 6–8, 1996, pp. 1–37.

Manuch Nikanjam, Chevron Research and Technology Company, "Development of the First CARB Certified California Alternative Diesel Fuel", 930728, pp. 507–520.

P. P. Shah, et al, "Fischer–Tropsch Wax Characterization and Upgrading Final Report", Jun. 6, 1988, DOE/PC/80017–T1, pp. li–v, 3–1 thru 3–9, 6–6, 6–7, 61–9, Fig. 6.1.

* cited by examiner

LOW EMISSIONS F-T FUEL/CRACKED STOCK BLENDS

This application is a continuation of 09/563,214 filed May 2, 2000 now ABN.

FIELD OF THE INVENTION

This invention relates to blends of a Fischer-Tropsch fuel and cracked stocks. More particularly, this invention relates to a blended fuel, as well as a method for its production, useful in diesel engines and having surprisingly low emissions characteristics.

BACKGROUND

A concern for future diesel fuels is the ability to use low value, high emissions materials currently produced in refineries in higher quality diesel fuels without extensive and expensive reprocessing. These materials typically have high density, may have high end boiling and T95 points, (the temperature at which most all the material has boiled off, leaving only 5% remaining in the distillation pot) high aromatic and polyaromatic contents and high sulfur contents. These factors have been shown to have a detrimental effect on emissions. For example, see the Coordinating Research Council (CRC) study on heavy duty diesels in the United States reported in SAE papers 932735, 950250 and 950251, and the European Programme on Emissions, Fuels and Engine Technologies (EPEFE) study on light and heavy duty diesels reported in SAE papers 961069, 961074 and 961075.

Particularly, increases in aromatic content of fuels have been cited as having a negative impact on emissions, see ASTM D 975-98b. As a result, the California Air Resources Board (CARB) mandated a maximum aromatics content for commercial diesel fuels of 10 volume % (9.5 wt %), see SAE Paper 930728. However, CARB permits some high aromatic and polyaromatic diesel 930728. However, CARB permits some high aromatic and polyaromatic diesel fuels to be produced and sold if it can be established that the higher aromatic and polyaromatic diesel fuel has combustion emissions properties at least equivalent to those of a standard 10 vol. % max aromatic fuel. See Subsection (g) of Section 2282, Title B, California Code of Regulations In contrast, emissions measurements on Fischer-Tropsch diesel fuels, which have virtually nil sulfur, aromatic and polyaromatic contents demonstrate favorable emissions characteristics. A report by the Southwest Research Institute (SwRI) entitled "The Standing of Fischer-Tropsch Diesel in an Assay of Fuel Performance and Emissions" by Jimell Erwin and Thomas W. Ryan, III, NREL (National Renewable Energy Laboratory) Subcontract YZ-2-113215, October 1993, details the advantage of Fischer-Tropsch fuels for lowering emissions when used neat, that is, use of pure Fischer-Tropsch diesel fuels.

Thus, there remains a need to develop a superior economic fuel blend useful as a diesel fuel while lowering emissions after combustion. In particular, emissions of solid particulate matter (PM) and nitrogen oxides (NOx) are especially important due to current and proposed environmental regulation. In this regard, the ability to incorporate cracked stocks in diesel fuels while maintaining emissions standards will provide a distinct economic advantage.

By virtue of the present invention, Fischer-Tropsch diesel fuels are blended with lower grade cracked stocks to produce a composition useful as a diesel fuel which satisfies current diesel emissions standards. Further, the blend of the present invention can incorporate higher concentrations of both polyaromatics and aromatics while maintaining or exceeding emissions specifications after combustion in a diesel engine.

The citations of the several SAE papers referenced herein are:

P. J. Zemroch, P. Schimmering, G. Sado, C. T. Gray and Hans-Martin Burghardt, "*European Programme on Emissions, Fuels and Engine Technologies-Statistical Design and Analysis Techniques*", SAE paper 961069.

M. Signer, P. Heinze, R. Mercogliano and J. J. Stein, "*European Programme on Emissions, Fuels and Engine Technologies-Heavy Duty Diesel Study*", SAE paper 961074.

D. J. Rickeard, R. Bonetto and M. Signer, "*European Programme on Emissions, Fuels and Engine Technologies-Comparison of Light and Heavy Duty Diesels*", SAE paper 961075.

K. B. Spreen, T. L. Ullman and R. L. Mason, "*Effects of Cetane Number, Aromatics and Oxygenates on Emissions from a* 1994 *Heavy-Duty Diesel Engine with Exhaust Catalyst*", SAE paper 950250.

K. B. Spreen, T. L. Ullman and R. L. Mason, "*Effects of Cetane Number on Emissions from a Prototype* 1998 *Heavy Duty Diesel Engine*", SAE paper 950251.

Thomas Ryan III and Jimell Erwin, "*Diesel Fuel Composition Effect on Ignition and Emissions*", SAE paper 932735.

M. Hublin, P. G. Gadd, D. E. Hall, K. P. Schindler, "*European Programme on Emissions, Fuels and Engine Technologies-Light Duty Diesel Study*", SAE paper 961073.

Manuch Nikanjam, "*Development of the First CARB Certified California Alternative Diesel Fuel*", SAE paper 930728.

SUMMARY OF THE INVENTION

In an embodiment of this invention, high quality Fischer Tropsch derived fuel is blended with cracked stocks to create a "dumbbell" blended fuel useful in diesel engines and capable of achieving acceptable emission quality. A "dumbbell" blend of the two fuels in accordance with this invention, satisfies all regulated diesel fuel specifications, e.g., ASTM D 975 and CARB, except for potentially larger than normal aromatic and polyaromatic content while being made up of two components, neither of which satisfies all required specifications e.g., for density, sulfur, aromatics, etc. For example, in one embodiment of this invention is provided a diesel fuel blend comprising a Fischer-Tropsch derived distillate which fails to satisfy the density specifications as specified in ASTM D 4052, blended with a cracked stock which fails to satisfy specification for either sulfur, nitrogen, aromatics, polyaromatics or mixtures thereof, as specified by ASTM D 975 and/or CARB. In this regard, the level of aromatics and polyaromatics in the final blend are about 10–35 wt. % and about 1–20 wt. %, respectively. Levels of aromatics and polyaromatics in the blend within this range can be much higher than typical European and California Air Resources Board (CARB) certified fuels well known in the art. Thus, the ability of the blend to maintain emissions standards at these high levels of aromatics and polyaromatics is unexpected.

While it has been known in the art that Fischer-Tropsch fuels can "upgrade" conventional fuels as predicted from simple, linear blending of the fuel parameters, i.e., as specified in "Fischer-Tropsch Wax Characterization and Upgrading Final Report" by P. P. Shah, G. C. Sturtevant, J. H. Gregor and M. J. Humbach, U.S. Department of Energy, Subcontract DE-AC22-85PC80017, Jun. 6, 1988, the unexpected benefit when using low grade cracked stocks in combination with high quality Fischer-Tropsch fuels has not been reported. Therefore, in one embodiment of the present invention is provided a diesel fuel blend containing greater than 9.5 wt % aromatics which has combustion emissions properties at least equivalent to those of a standard 10 vol. % max aromatic diesel fuel as specified in Subsection (g) of Section 2282, Title 13, California Code of Regulations. For reference herein, the conversion of vol. % aromatics to wt. % aromatics is in accord with the CARB accepted formula:

| | |
|---|---|
| Vol. % aromatics = (by ASTM D 1319 | 0.916 wt. % aromatics + 1.33 (by ASTM D 5186) |

The blended fuel of the invention is produced by blending a hydrocarbon distillate boiling in the range of a diesel fuel, preferably a 250–700° F. distillate fraction derived from a Fischer-Tropsch process containing

| | |
|---|---|
| paraffins | at least 90+ wt %, preferably at least 95+ wt %, more preferably at least 99+ wt % |
| sulfur | ≦50 ppm (wt), preferably undetectable by x-ray fluorescence for example, as described in ASTM D 2622 |
| nitrogen | ≦50 ppm (wt), preferably undetectable by chemiluminescence detection, for example, as described in ASTM D 4629 |
| aromatics | <1 wt. %, preferably <0.5 wt. %, more preferably <0.1 wt. % |
| cetane number | >65, preferably >70, more preferably >75 |

which is blended with a cracked stock boiling in the range of a diesel fuel, preferably in the range of 250–800° F., wherein the blended fuel contains 20–35 wt. % aromatics and 10–20 wt. % polyaromatics, preferably 10–35 wt. % aromatics and 1–20 wt. % polyaromatics. Even more preferably, the Fischer-Tropsch distillate fraction comprises a 320–700° F. fraction and the cracked stock comprises a 450–700° F. distillate fraction. In the blend, the Fischer-Tropsch derived fuel preferably comprises at least 5–90 vol. % of the blended diesel fuel, more preferably at least 20–80 vol. %, even more preferably at least 40–80 vol. %, still more preferably at least 50–70 vol. %.

Another embodiment of the invention comprises a method for operating a diesel engine which results in low regulated emissions comprising combusting a blended fuel with oxygen or an oxygen containing gas, e.g., air, the blended fuel comprising;

(a) a hydrocarbon distillate boiling in the range of 250–700° F. derived from a Fischer-Tropsch process and containing at least 90 wt. % paraffins
≦50 ppm (wt) sulfur, nitrogen
<1 wt. % aromatics, and (b) a cracked stock boiling in the range of 250–800° F. and containing
≧30 wt. % aromatics
≧20 wt. % polyaromatics wherein the blended fuel contains 10–35 wt. % aromatics and 1–20 wt. % polyaromatics.

DETAILED DESCRIPTION

Figure 1:
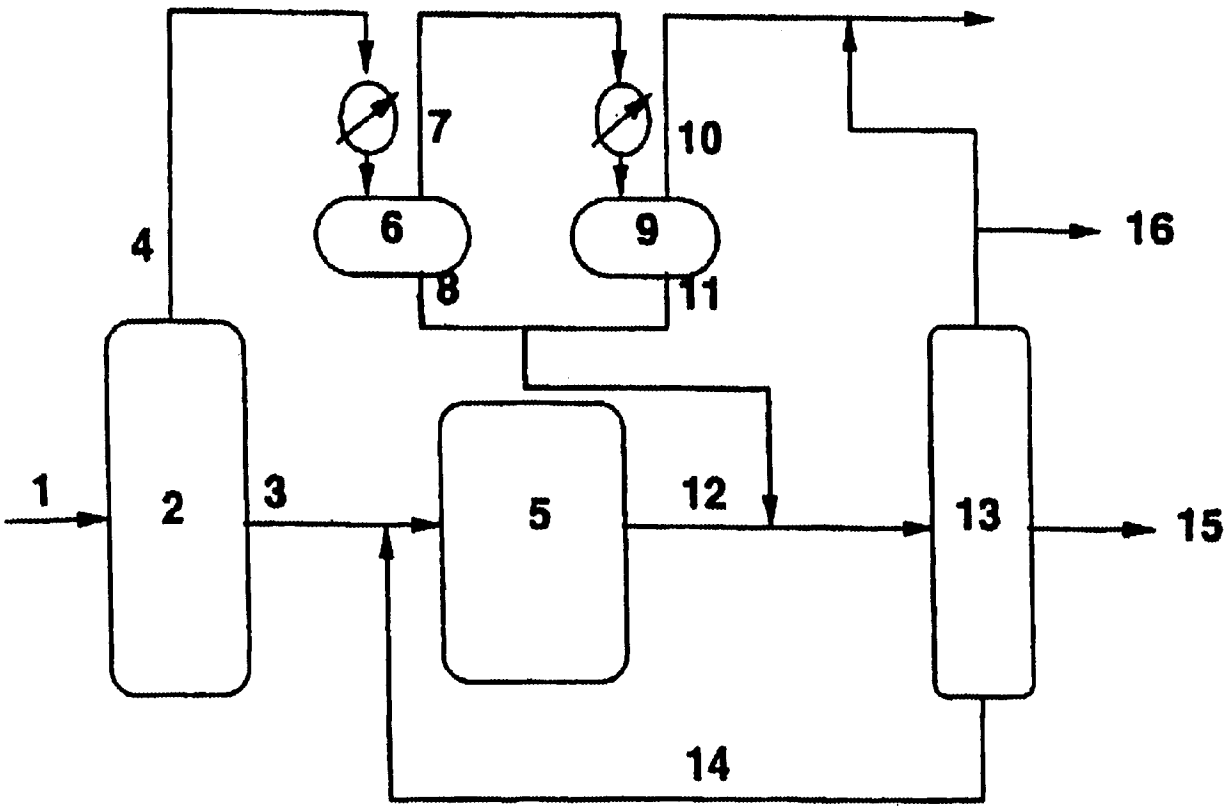
FIG. 1 is a schematic of a process in accordance with an embodiment of this invention.

The Fischer-Tropsch process is well known to those skilled in the art, see for example, U.S. Pat. Nos. 5,348,982 and 5,545,674 herein incorporated by reference. Typically the Fischer-Tropsch process involves the reaction of a synthesis gas feed comprising hydrogen and carbon monoxide fed into a hydrocarbon synthesis reactor in the presence of a Fischer-Tropsch catalyst, generally a supported or unsupported Group VIII, non-noble metal to produce a waxy paraffinic product. These processes include fixed bed, fluid bed and slurry hydrocarbon syntheses. Preferably, the catalyst is a non-shifting catalyst. Regardless of the catalyst or conditions employed, the high proportion of normal paraffins in the product must be converted into more usable products, such as transportation fuels. Conversion is accomplished primarily by hydrogen treatments in the presence of a suitable catalyst involving one or more of hydrotreating, hydroisomerization, dewaxing and hydrocracking.

By virtue of the Fischer-Tropsch process, the Fischer-Tropsch derived distillate has essentially nil sulfur and nitrogen. These hereto-atom compounds are poisons for Fischer-Tropsch catalysts and are removed from the synthesis gas that is the feed for the Fischer-Tropsch process. Further, the process does not make aromatics, or as usually operated, virtually no aromatics are produced. Some olefins and oxygenates are produced since one of the proposed pathways for the production of paraffins is through an olefinic intermediate. Preferably, olefin concentration in the Fischer-Tropsch derived distillate is less than 10 vol. %, preferably less than 5 vol. %, even more preferably less than 1.0 vol. % (ASTM D 2710). Nevertheless, olefin and oxygenate concentration are relatively low, and essentially nil after treatment by any of the above hydrogen treatment steps.

The Fischer-Tropsch derived distillates that may be used in the blends of this invention include distillates recovered from the Fischer-Tropsch reactor, whether or not hydrotreated, i.e., hydrogen treatments in the presence of a suitable catalyst including but not limited to one or more of hydrotreating, hydroisomerization, dewaxing and hydrocracking, as well as distillates recovered from fractionating the wax product from the Fischer-Tropsch reactor, whether or not hydrotreated.

A more detailed description of the preferred Fischer-Tropsch fuels utilized for comparison in the examples may be had by referring to FIG. 1. Synthesis gas, hydrogen and carbon monoxide in an appropriate ratio, contained in line 1 is fed to a Fischer-Tropsch reactor 2, preferably a slurry reactor and product is recovered in lines 3 and 4, 700° F.+ and 700° F.− respectively. The lighter fraction goes through hot separator 6 and the 500–700° F. fraction is recovered, in line 8, while a 500° F. fraction is recovered in line 7. The 500° F.− material goes through cold separator 9 from which $C_4$-gases are recovered in line 10. A $C_5$-500° F. fraction is recovered in line 11 and is combined with the 500–700° F. fraction in line 8. At least a portion and preferably most, more preferably essentially all of this $C_5$-700 fraction is blended with the hydroisomerized product in line 12.

The heavier, e.g., 700° F.+ fraction, in line 3 is sent to hydroisomerization unit 5 which is running 50% conversion per pass and 100% recycle of the 700° F.+ material to the input of the hydroisomerization unit 5. Typical broad and preferred conditions for the hydoisomerization process unit are shown in the table below:

| Condition | Broad Range | Preferred Range |
|---|---|---|
| Temperature, ° F. | 300–800 | 550–750 |
| Total Pressure, psig | 0–2500 | 300–1200 |
| Hydrogen Treat Rate, SCF/B | 500–5000 | 2000–4000 |
| Hydrogen Consumption Rate, SCF/B | 50–500 | 100–300 |

While many catalysts for hydroisomerization or selective hydrocracking may be satisfactory for this step, some catalysts perform better than others and are preferred. For example, catalysts containing a supported Group VIII noble metal, e.g., platinum or palladium, are useful as are catalysts containing one or more Group VIII base metals, e.g., nickel, cobalt, in amounts of about 0.5–20 wt % which may or may not also include a Group VI metal, e.g., molybdenum, in amounts of about 1–20 wt %. The metal Groups referred to herein are those found in the Sargent-Welch Periodic Table of the Elements, copyright 1968. The support for the metals can be any refractory oxide or zeolite or mixtures thereof Preferred supports include silica, alumina, silica-alumina, silica-alumina phosphates, titania, zirconia, vanadia and other Group III, IV, VA or VI oxides, as well as Y sieves, such as ultra-stable Y sieves. Preferred supports include alumina and silica-alumina where the silica concentration of the bulk support is less than about 50 wt %, preferably less than about 35 wt %.

A preferred catalyst has a surface area in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

Preferred catalysts comprise a non-noble Group VIII metal, e.g., iron, nickel, in conjunction with a Group IB metal, e.g., copper, supported on an acidic support. The support is preferably an amorphous silica-alumina where the silica is present in amounts of less than about 30 wt %, preferably 5–30 wt %, more preferably 1–20 wt %. Also, the support may contain small amounts, e.g., 20–30 wt % of a binder, e.g., alumina, silica, Group IVA metal oxides and various types of clays, magnesia, etc., preferably alumina. The catalyst is prepared by co-impregnating the metals from solutions onto the support, drying at 100–150° C., and calcining in air at 200–500° C.

The Group VIII metal is present in amounts of about 15 wt % or less, preferably 1–12 wt %, while the Group IB metal is usually present in lesser amounts, e.g., 1:2 to about 1:20 ratio respecting the Group VIII metal. A typical catalyst is shown below:

| | |
|---|---|
| Ni, wt % | 2.5–3.5 |
| Cu, wt % | 0.25–0.35 |
| $Al_2O_3$—$SiO_2$ | 65–75 |
| $Al_2O_3$ (binder) | 25–35 |
| Surface Area, $m^2$/g | 290–325 |
| Total Pore Volume (Hg), ml/g | 0.35–0.45 |
| Compacted Bulk Density, g/ml | 0.58–0.68 |

The 700° F.+ conversion to 700° F.− in the hydroisomerization unit ranges from about 20–80%, preferably 20–50%, more preferably about 30–50%. During hydroisomerization essential all olefins and oxygen containing materials are hydrogenated.

The hydroisomerization product recovered in line 12 into which the $C_5$-700° F. stream of line 8 and 11 are blended. The blended stream is fractionated in tower 13, from which 700° F.+ is, optionally, recycled in line 14 back to line 3, $C_5$-is recovered in line 16 and a clean distillate boiling in the range of 250–700° F. is recovered in line 15.

The oxygenates are contained essentially, e.g., ≧95% of the oxygenates, in the lighter fraction, e.g., the 700° F.− fraction. Further, the olefin concentration of the lighter fraction is sufficiently low as to make olefin recovery unnecessary; and further treatment of the fraction for olefins is avoided.

The preferred Fischer-Tropsch process is one that utilizes a non-shifting (that is, no water gas shift capability) catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898. The hydrogen:CO ratio in the process is at least about 1.7, preferably at least about 1.75, more preferably 1.75 to 2.5.

For comparison, two "neat" Fischer-Tropsch fuels were prepared; Fuel A and Fuel B. Fuel A is a distillate boiling in the range of 250–700° F. recovered from line 15. Fuel B comprises the hydro-isomerate only, boiling in the range of 320–700° F. recovered from line 12 immediately after passing through the hydroisomerization unit 15 and prior to blending with line 8. Characteristics of Fuels A and B are detailed in Table 1 below.

The following test procedures were applied to determine the characteristics for each of the fuels used in the following comparisons and examples. Cetane levels are representative of cetane number and were calculated using ASTM method D-613 for Cetane Number of Diesel Fuel Oil. Sulfur levels were analyzed by x-ray fluorescence spectrometry such as described in ASTM D-2622. Density was determined using ASTM test method D-4052. Levels of aromatics and polyaromatics were determined using IP-391. Nitrogen may be measured by syringe/inlet oxidative combustion with chemiluminescence detection as described in ASTM D4629 and weight percent of paraffins may be measure as described in ASTM D5292. Concentrations listed as "0" correspond to concentrations below the detectable limits of the analytical techniques detailed above. In the claims hereinafter, unless another test method is specified, the foregoing test methods will be applicable in determining cetane, sulfur aromatics and polyaromatics respectively.

TABLE 1

("Neat" Fischer-Tropsch Fuels)

| PROPERTY | FUEL A | FUEL B |
|---|---|---|
| Boiling Range | 250–700° F. | 320–700° F. |
| Cetane number | 79.1 | 74 |
| Aromatics | 0 | 0 |
| Polyaromatics | 0 | 0 |
| Sulfur | 0 | 0 |
| Density | 0.7754 | 0.7830 |

Both the "neat" Fischer-Tropsch diesels and the blends of this invention were compared with typical diesel fuels known in the art (base fuels) and results produced based on emission test data. The following results demonstrate that the blend of applicants invention can achieve emissions levels equivalent to or superior to the base fuels while containing greater levels of aromatics and polyaromatics.

The properties of the conventional, petroleum derived base fuels used for comparison, in this case an "average"

U.S. low sulfur No. 2-D diesel fuel; ASTM D975-98b (Fuel D), a CARB certified diesel fuel (Fuel E) and a typical European low sulfur diesel fuel; LSADO (Fuel F) are shown in Table 2. Fuel characteristics were determined using standard ASTM methods for each fuel property.

TABLE 2

| | (Base Fuels) | | |
|---|---|---|---|
| PROPERTY | FUEL D | FUEL E | FUEL F |
| Boiling Range | 376–651° F. | 410–652° F. | 347–678° F. |
| Cetane number | 45.5 | 50.2 | 51.1 |
| Aromatics (wt %) | 31.9 | 8.7 | 29.2 |
| Polyaromatics (wt %) | * | 0.3 | 9.2 |
| Sulfur (wt %) | 0.033 | .0345 | 0.14 |
| Density | 0.8447 | .8419 | 0.8511 |

* Polyaromatic/aromatic split not measured in SwRI study.

The term "cracked stocks" as used here, and in the claims, refers to the distillate fraction product of any process, thermal or catalytic, which produces cracked stocks boiling in or slightly above the typical diesel fuel range, preferably 250–800° F., even more preferably 450–700° F. For example, fluid catalytic cracking, thermal cracking and vis-breaking or mixtures thereof. Cracked stocks are materials which can not be qualified as specification diesel fuel when used 'neat' (due to any of the following: high Sulfur, density and/or aromatic level and low cetane) to make a fuel with properties capable of meeting current diesel fuel specifications. However, cracked stocks can be pretreated by known methods, i.e., diesel oil de-sulfurization, to reduce sulfur content, if such sulfur reduction is necessary or desired. Fuel G is a light catalytic cycle oil. Fuel H is a heavy catalytic heating oil. Properties of the cracked stocks used within applicants comparative blend are detailed below in Table 3. Aromatic/Polyaromatic split was determined using IP-391.

TABLE 3

| | (Cracked Stocks) | |
|---|---|---|
| PROPERTY | FUEL G | FUEL H |
| Boiling Range | 249–788° F. | 361–725° F. |
| Cetane number | 33.7 | about 27 |
| Aromatics (wt %) | 54.4 | 70.2 |
| Polyaromatics (wt %) | 25.4 | 40.7 |
| Sulfur (wt %) | 0.066 | 0.27 |
| Density | 0.8922 | 0.9287 |

Several blends simulating conventional diesel fuel were prepared using the Fischer-Tropsch fuels represented in Table 1 and the cracked stocks represented in Table 3. The properties of the simulated conventional blends used for comparison are detailed below and in Table 4. Preferably, the blended fuel contains less than 500 wppm sulfur, even more preferably less than 200 wppm sulfur. Values of aromatics and polyaromatics contained in the blends were determined by multiplying the known content of polyaromatics and aromatics in each cracked stock by the percentage content of the each cracked stock within specific blends.

Fuel (X) 50% Fuel A+50% Fuel G

Fuel (Y) 57% Fuel B+43% Fuel H

Fuel (Z) 52% Fuel B+48% Fuel H

TABLE 4

| | (Blends) | | |
|---|---|---|---|
| PROPERTY | FUEL X | FUEL Y | FUEL Z |
| Boiling Range | 250–700° F. | 250–700° F. | 345–700° F. |
| Cetane number | 56.3 | 51 | 48.2 |
| Aromatics (wt %) | 27.2 | 32.1 | 36.9 |
| Polyaromatics (wt %) | 12.7 | 17.5 | 21.2 |
| Sulfur (wt %) | 0.033 | 0.14 | 0.15 |
| Density | 0.8285 | 0.838 | 0.8511 |

Results on Engine Testing

A) The fuels were evaluated in a CARB- approved "test bench," identified as a prototype 1991 Detroit Diesel Corporation Series 60 Heavy Duty Diesel Engine. The important characteristics of the engine are given in Table 5. The engine, as installed in a transient-capable test cell, had a nominal rated power of 330 hp at 1800 rpm, and was designed to use an air-to-air intercooler; however, for dynamometer test work, a test cell intercooler with a water-to-air heat exchanger was used. No auxiliary engine cooling was required.

TABLE 5

| Characteristics of Prototype 1991 DDC Series 60 Heavy Duty Engine | |
|---|---|
| Engine Configuration and Displacement | 6-Cylinder, 11.1 L, 130 mm. Bore × 130 mm. Stroke |
| Aspiration | Turbocharged, After-cooled (air-to-air) |
| Emission Controls | Electronic Management of Fuel Injection and Timing (DDEC-II) |
| Rated Power | 330 hp. at 1800 rpm with 108 lb./hr. Fuel |
| Peak Torque | 1270 lb.-ft. at 1200 rpm with 93 lb./hr. Fuel |
| Injection | Direct Injection, Electronically Controlled Unit Injectors |
| Maximum Restrictions | |
| Exhaust | 2.9 in. Hg at Rated Conditions |
| Intake | 20 in. $H_2O$ at Rated Conditions |
| Low Idle Speed | 600 rpm. |

Regulated emissions were measured during hot-start transient cycles. Sampling techniques were based on transient emissions test procedures specified by the EPA in CPR 40, Part 86, Subpart N for emissions regulatory purposes. Emissions of hydrocarbon (HC), carbon monoxide (CO), nitrous oxide (NOx) and particulate matter (PM) were measured.

Table 6 below shows the results of the test reporting the data as % increase (positive) or % decrease (negative) for each type of emissions relative to the base U.S. No. 2-D low sulfur diesel fuel (Fuel D). The data reveals significantly lower emissions with applicants blend, Fuel X, than observed with the base Fuel D. In particular, applicants blend produced emissions with a 38% decrease in hydrocarbons, 30% decrease in carbon monoxide, 4.1% decrease in nitrogen oxides and 0.9% decrease in particulate matter as compared to Fuel D, the U.S. diesel fuel.

Comparing applicants blend, Fuel X to the California diesel, Fuel E, we find the emissions results to be very similar with slight advantages in hydrocarbons and carbon monoxide emissions for Fuel X and slight disadvantages in NOx and PM. Fuel A, the "neat" Fischer-Tropsch demonstrated the lowest emissions in comparison to the other fuels.

TABLE 6

| FUEL | HC | CO | NOx | PM |
|---|---|---|---|---|
| A: Fischer-Tropsch Fuel | −41 | −47 | −9.2 | −31 |
| E: California | −34 | −17 | −7.3 | −7.7 |
| X: F-T/cracked stock blend(A + G) | −38 | −30 | −4.1 | −0.9 |

This data demonstrates that we can achieve emissions equivalent to a CARB Diesel with 18% more aromatics and 9% more polyaromatics present within applicants blend than contained in the CARB Diesel. Further, emissions from applicants blend are far superior than a comparable standard US No. 2-D low sulfur diesel fuel (Fuel D) despite the fact that the blend has similar levels of aromatics and sulfur as contained in the US diesel.

Relative emissions from Table 6 are further detailed in the graph of FIG. 2.

B) A Light Duty Diesel vehicle was used to compare Fuel A, Fuel Y and Fuel Z to the base fuel, Fuel F. The resulting emissions tests were performed on a VW Jetta Indirect Injection (IDI) diesel passenger car using the ECE-EUDC European test cycle to determine the maximum level of aromatics and polyaromatics which could be incorporated into a Fischer-Tropsch fuel by addition of the cracked stocks of Table 3, while still producing emissions equivalent to the base European Diesel, Fuel F.

The light duty European test cycle is performed in two parts:

ECE: this urban cycle represents inner city driving conditions after a cold start with a maximum speed of 50 km/h, and EUDC: the extra-urban driving cycle is typical of suburban and open road driving behavior and includes speeds up to 120 km/h. The data is based on the combined emissions of the ECE and EUDC cycles expressed in g/km. See SAE Paper 961073; European Programme on Emissions, Fuels and Engine Technologies (EPEFE)-Light Duty Diesel Study, P. Gadd, K. P. Schindler, D. Hall and SAE Paper 961068; European Programme on Emissions, Fuels and Engine Technologies (EPEFE)-Vehicle and Engine Testing Procedures, J. J. Stein, N. G. Elliot, J. P. Pochic.

Table 7 below indicates the comparative emissions for Fuels A, Y and Z relative to the base fuel, Fuel F. The numerical results of the test reporting the data represent % increase (positive) or % decrease (negative) in absolute emissions relative to the emissions produced by the base fuel, Fuel F.

TABLE 7

| FUEL | HC | NOx | CO | PM |
|---|---|---|---|---|
| A: Fischer-Tropsch Fuel | −73% | −4% | −54% | −63% |
| Y: Blend (250–700° F.) | −1% | −5% | −4% | −3% |
| Z: Blend (345–700° F.) | 18% | 2% | 3% | 14% |

Analysis of the data reveals that Fuel Y, containing 32.1% and 17.5% aromatics and polyaromatics respectively, had statistically equivalent emissions as compared to Fuel F, which contains only 9.2% polyaromatics, with the exception of slightly superior NOx reduction for Fuel Y. In particular, Fuel Y demonstrated a 1% decrease in HC, 5% decrease in NOx, 4% decrease in CO and a 3% decrease in PM. Fuel Z, containing 36.9% and 21.2% aromatics and polyaromatics respectively, produced emissions slightly inferior as compared to Fuel F. In this regard, both Fuel Y and Fuel Z had a substantially higher aromatic and polyaromatic content than that of Fuel F (29.2% aromatic and 9.2% polyaromatic content) while still producing comparable or superior emissions results.

Thus, the data demonstrates that applicants can incorporate higher concentrations of polyaromatics in "dumbbell" cracked stock/Fischer-Tropsch blends while maintaining equivalent emissions as compared to the base fuels utilized in the study. The maximum amount of polyaromatics is about 20% of the blend or about twice the level contained in the comparable base fuel. The total aromatic content may also be about 10–20% higher than the base fuel, i.e. up to 25–35% aromatic content in the blend. This increase in aromatic and polyaromatic content is achieved while maintaining an approximate match in other fuel properties and producing a fuel which satisfies current diesel specifications.

What is claimed is:

1. A method for operating a diesel engine to produce low emissions which comprises combusting a blended fuel with oxygen or an oxygen containing gas, the fuel comprising;

(a) at least 5–90 wt. % of a hydrocarbon distillate boiling in the range of 250–700° F. derived from a Fischer-Tropsch process and containing at least 90 wt. % paraffins
≦50 wppm sulfur, nitrogen
<1 wt. % aromatics, and (b) a cracked stock boiling in the range of 250–800° F. and containing
≧30 wt. % aromatics
≧20 wt. % polyaromatics wherein the blended fuel contains 10–35 wt. % aromatics and 1–20 wt. % polyaromatics, and <500 wppm sulfur, and the blend having combustion emissions properties at least equivalent to those of a 10 vol. % aromatic fuel under subsection (g), Section 2282, Tide B, of the California Code of Regulations.

2. The method of claim 1 wherein the Fischer-Tropsch distillate comprises at least 20 vol. % of the blended diesel fuel.

3. The method of claim 2 wherein the Fischer-Tropsch distillate comprises at least 40 vol. % of the blended diesel fuel.

4. The method of claim 1 wherein the cracked stock contains ≧50 wt. % aromatics and ≧30 wt. % polyaromatics.

5. The method of claim 1 wherein the blended fuel contains 20–30 wt. % aromatics and 10–20 wt. % polyaromatics.

6. The method of claim 1 wherein the Fischer-Tropsch distillate boils in the range of 320–700° F.

7. The method of claim 1 wherein the cracked stock fuel boils in the range of 450–700° F.

8. The method of claim 1 wherein the Fischer-Tropsch process is a non-shifting Fischer-Tropsch catalyst process.

9. The method of claim 8 wherein the non-shifting Fischer-Tropsch catalyst comprises cobalt.

10. The method of claim 9 wherein the non-shifting Fischer-Tropsch catalyst is a supported cobalt catalyst.

11. A process for producing a diesel engine fuel which produces low regulated emissions after combustion from a cracked stock boiling in the range of 250–800° F. and containing ≧30 wt. % aromatics and ≧20 wt. % polyaromatics comprising blending said cracked stock with a 250–700° F. distillate fraction derived from the Fischer-Tropsch process to form a diesel fuel blend containing 10–35 wt. % aromatics and 1–20 wt. % polyaromatics and having a cetane number of at least 45.

12. A process according to claim 11 wherein said Fischer-Tropsch distillate fraction contains:

at least 90 wt. % paraffins,

≦50 wppm sulfur,

≦50 wppm nitrogen, and

≦1 wt. % aromatics.

13. A process according to claim 12 wherein said Fischer-Tropsch fraction contains at least 95 wt. % paraffins and ≦0.5 wt. % aromatics.

14. A process according to claim 12 wherein said Fischer-Tropsch fraction contains at least 99 wt. % paraffins and ≦0.1 wt. % aromatics.

15. A process according to claim 12 wherein said Fischer-Tropsch fraction has a cetane number of at least 65.

16. A process according to claim 11 wherein said Fischer-Tropsch fraction comprises at least 20 vol. % of the blended diesel fuel.

17. A process according to claim 11 wherein said Fischer-Tropsch fraction comprises at least 40 vol. % of the blended diesel fuel.

18. A process according to claim 11 wherein the blend contains 20–30 wt. % aromatics and 10–20 wt. % polyaromatics.

19. A fuel useful for combustion in a diesel engine comprising a blend of:

(a) at least 5–90 wt. % of a hydrocarbon distillate boiling in the range of 250–700° F. derived from a Fischer-Tropsch process, and containing at least 90 wt. % paraffins
≦50 wppm sulfur, nitrogen
<1 wt. % aromatics,
>65 cetane number, and (b) a cracked stock boiling in the range of 250–800° F. and containing
≧30 wt. % aromatics
≧20 wt. % polyaromatics wherein the blended fuel contains 10–35 wt. % aromatics and 1–20 wt. % polyaromatics, and <500 wppm sulfur, and the blend having combustion emissions properties at least equivalent to those of a 10 vol. % aromatic fuel under subsection (g), Section 2282, Title B, of the California Code of Regulations.

20. The material of claim 19 wherein the Fischer-Trospch derived distillate contains:

at least 95 wt. % paraffins

<0.5 wt. % aromatics.

21. The material of claim 19 wherein the Fischer-Trospch derived distillate contains:

at least 99 wt. % paraffins

<0.1 wt. % aromatics.

22. The material of claim 19 wherein the blended fuel contains less than 200 wppm sulfur.

23. The material of claim 19 wherein the Fischer-Tropsch distillate comprises at least 20 vol. % of the blended fuel.

24. The material of claim 19 wherein the Fischer-Tropsch distillate comprises at least 40 vol. % of the blended fuel.

25. The material of claim 19 wherein the Fischer-Tropsch process is a non-shifting Fischer-Tropsch process.

26. The material of claim 25 wherein the non-shifting Fischer-Tropsch catalyst comprises cobalt.

27. The material of claim 26 wherein the non-shifting Fischer-Tropsch catalyst is a supported cobalt catalyst.

28. The material of claim 19 wherein the Fischer-Tropsch distillate boils in the range of 320–700° F.

* * * * *